US005743475A

United States Patent [19]

Catani

[11] Patent Number: 5,743,475

[45] Date of Patent: Apr. 28, 1998

[54] TUBULAR MILL FOR GRINDING NATURAL AND SYNTHETIC RAW MATERIALS IN PARTICULAR FOR THE CEMENT INDUSTRY

[75] Inventor: Paolo Catani, Bergamo, Italy

[73] Assignee: Italcementi S.p.A., Bergamo, Italy

[21] Appl. No.: 663,115

[22] PCT Filed: Dec. 23, 1994

[86] PCT No.: PCT/EP94/04311

§ 371 Date: Jun. 20, 1996

§ 102(e) Date: Jun. 20, 1996

[87] PCT Pub. No.: WO95/17967

PCT Pub. Date: Jul. 6, 1995

[30] Foreign Application Priority Data

Dec. 27, 1993 [IT] Italy ..... MI93A2739

[51] Int. Cl.[6] ..... B02C 17/10

[52] U.S. Cl. ..... 241/57; 241/152.2; 241/228

[58] Field of Search ..... 241/152.2, 104, 241/105, 108, 228, 299, 173, 174, 176, 178, 57, 181, 183, 72, 251, 252

[56] References Cited

U.S. PATENT DOCUMENTS

| | | | |
|---|---|---|---|
| 1,064,680 | 6/1913 | Bartlet | 241/228 |

FOREIGN PATENT DOCUMENTS

| | | | |
|---|---|---|---|
| 486371 | 5/1992 | European Pat. Off. . | |
| 1085844 | 2/1955 | France . | |
| 424565 | 4/1926 | Germany . | |
| 548555 | 4/1932 | Germany . | |
| 3134601 | 5/1983 | Germany . | |
| 3618461 | 12/1986 | Germany . | |
| 1512655 | 10/1989 | U.S.S.R. | 241/252 |
| 1524258 | 3/1992 | U.S.S.R. | 241/228 |
| 2132506 | 7/1984 | United Kingdom . | |

*Primary Examiner*—Mark Rosenbaum

*Attorney, Agent, or Firm*—Oblon, Spivak, McClelland, Maier & Neustadt, P.C.

[57] ABSTRACT

A tubular mill for grinding natural and synthetic raw materials, in particular for the cement industry, includes a rotary cylindrical drum (11, 111) arranged with its axis (27) horizontal and containing at least one grinding element (25, 34), in which there are one or more grinding chambers (22; 23, 123) connected together, in at least one (22) of which the grinding element consists of a roller (25) which when in its operating position has its axis (26) essentially parallel to the axis (27) of the drum (11, 111) and is supported by an independent external pressure and extraction support (28), the roller (25) being idle and, at least along one of its outer generating lines, engaging an annular grinding track (24) rigid with the inner wall of the drum. As the grinding element for the second chamber (23), the mill can include a second roller (34) arranged and supported as the first roller (25), or a plurality of grinding balls.

15 Claims, 3 Drawing Sheets

TUBULAR MILL FOR GRINDING NATURAL AND SYNTHETIC RAW MATERIALS IN PARTICULAR FOR THE CEMENT INDUSTRY

TECHNICAL FIELD

This invention relates to a tubular mill for grinding natural and synthetic raw materials, in particular for the cement industry.

BACKGROUND ART

For grinding natural and synthetic raw materials, particularly in the cement industry, vertical mills are known comprising a track rotating about a vertical axis with two or more grinding rollers. The rollers rotate idly each about its axis (horizontal or inclined a few degrees to the horizontal) and comprise their own independent support and pressure systems.

Although the grinding efficiency of these mills is much higher than traditional tubular mills containing a load of different diameter balls, the material once having passed under the rollers is thrown outwards by the centrifugal force impressed on it by the grinding track, by virtue of the fact that the track rotates about the vertical axis. Said material thus has to be returned to the center of the track by pneumatic or mechanical systems for further processing under the rollers.

Such conveying systems however have a high energy consumption which largely nullifies the advantage of the vertical mill over traditional ball mills.

As a development of the aforesaid mills, tubular mills have been constructed with one or more grinding rollers pressed radially along a generating line of the mill. The rollers are supported by a single shaft inserted internally through the drum and supported externally at its two ends. This represents a constructional constraint which has limited its size and length, said shaft or beam being able to bend under the thrust of the rollers and having to be withdrawn axially and with difficulty in the case of mill maintenance. DE-C-626.565 discloses a tubular mill according to the preamble of claim 1.

DISCLOSURE OF INVENTION

The object of the present invention is to provide a mill which while maintaining the advantages of vertical tubular ball or roller mills is constructed in such a manner as to exert high optimized working pressures or each roller without prejudicing the structure, and allows easier maintenance, including on each individual roller.

This object is attained according to the present invention by a tubular mill for grinding natural and synthetic raw materials, in particular for the cement industry, according to claim 1.

BRIEF DESCRIPTION OF THE DRAWINGS

The characteristics and advantages of the mill according to the invention will be more apparent from the description of some embodiments thereof given hereinafter by way of non-limiting example with reference to the accompanying schematic drawings, in which.

BEST MODE FOR CARRYING OUT THE INVENTION

The figures show a tubular mill for grinding natural and synthetic raw materials, in particular for the cement industry. The mill is of the type comprising a rotary cylindrical drum 11 arranged with its axis horizontal and containing at least one grinding element.

Figure 1:
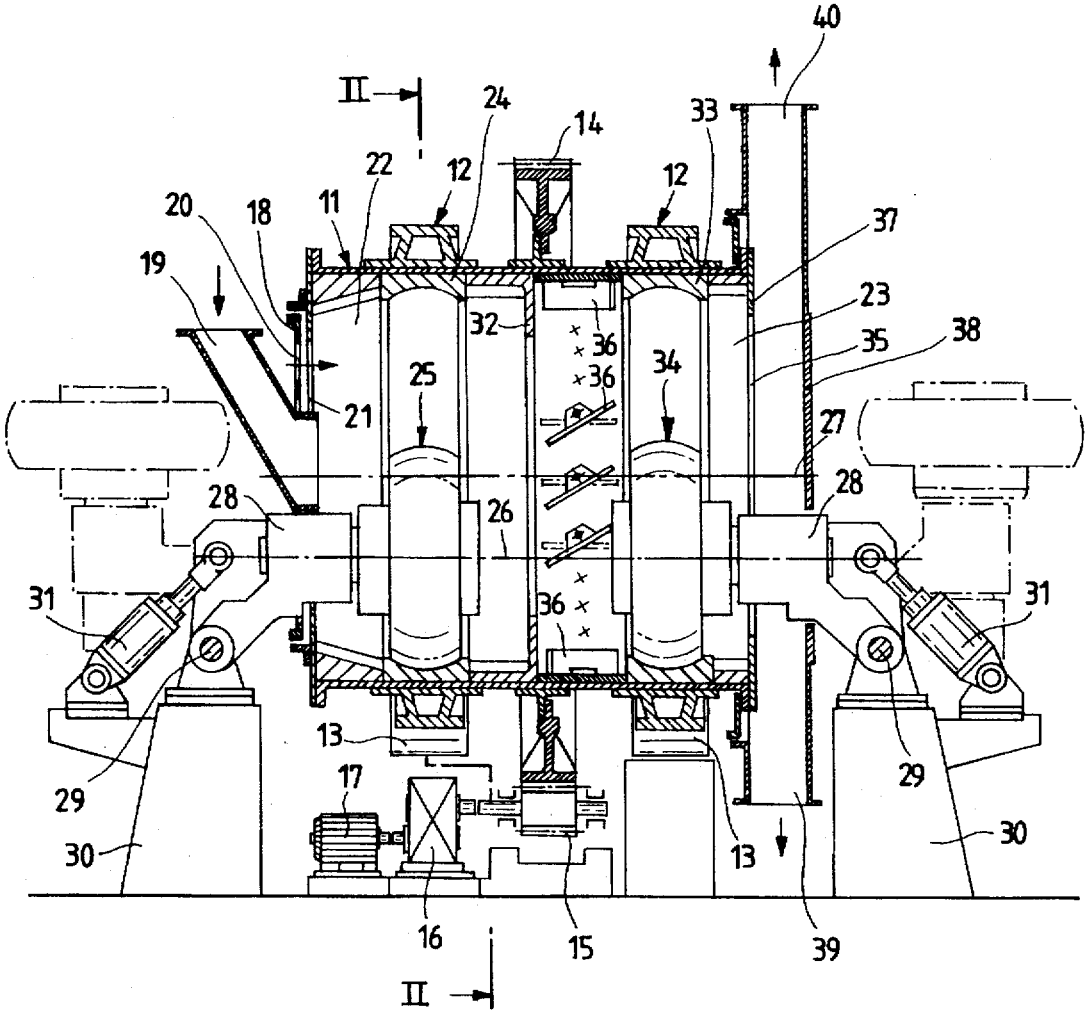
FIG. 1 is a longitudinal section through the mill of the present invention on the line I—I of FIG. 2.
Figure 2:
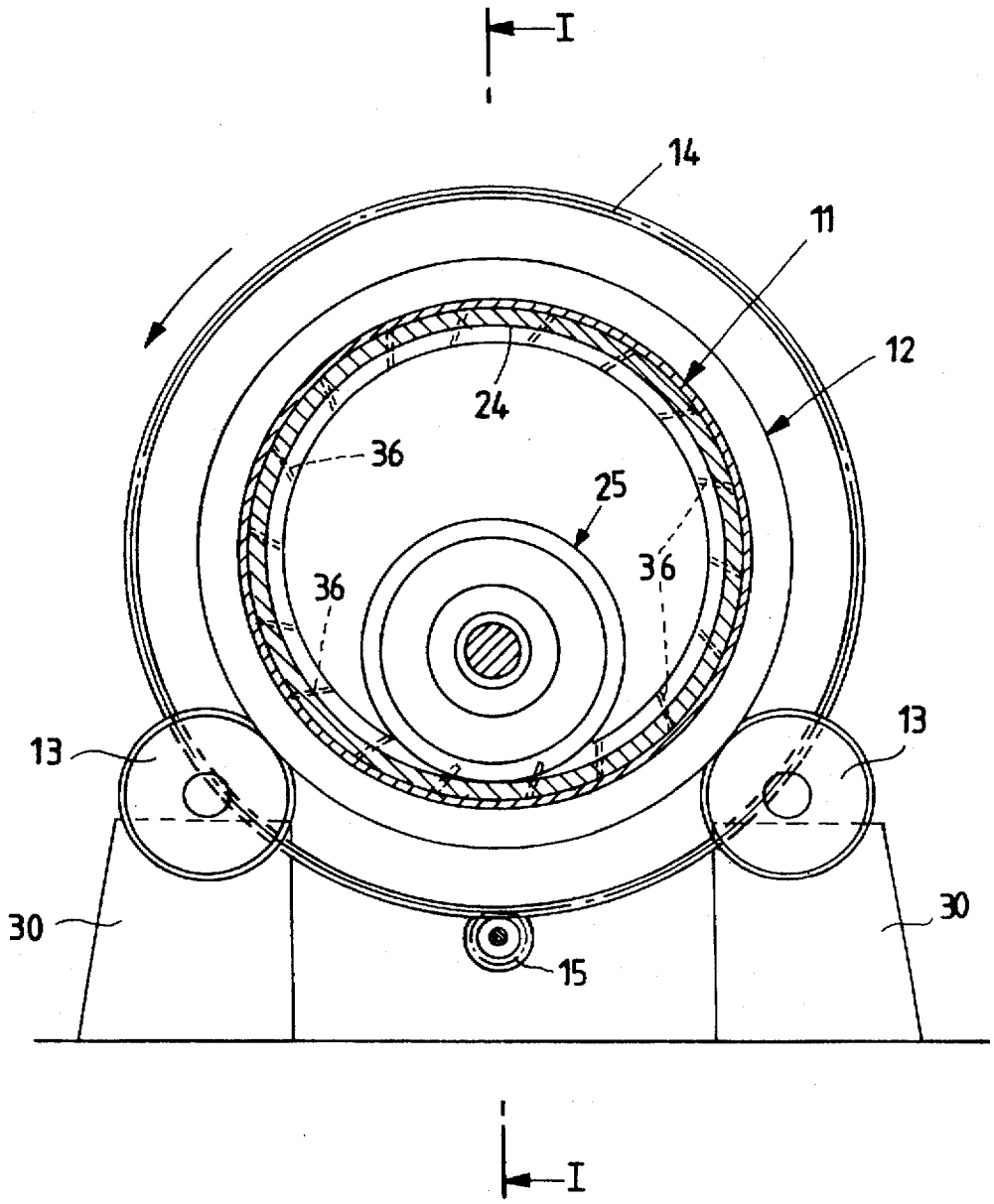
FIG. 2 is a cross-section on the line II—II of FIG. 1.

In the embodiment shown in FIGS. 1 and 2, the drum 11 rigidly carries on its outer surface two rolling or sliding rings 12 each resting on a pair of rolling-contact rollers 13 or alternatively on hydrostatic or hydrodynamic slide shoes, not shown. The outer surface of the drum 11 is provided with a circular ring gear 14, of larger diameter than the two rings 12, which engages and is rotated by a toothed pinion 15 moved by a reduction gear 16 connected to a motor 17. At one end of the drum 11 there is positioned a cover element 18, which is fixed and is provided with a feed mouth 19 for the material to be ground. The cover element 18 also comprises a local aperture 20 through which ventilation air or gas is fed. This hot or cold co-current ventilation facilitates material advancement along the mill. The cover element 18 faces a drum end or entry opening 21 connected to a first grinding chamber 22. In the illustrated embodiment the drum 11 comprises two grinding chambers 22 and 23 connected together at an intermediate portion of the drum.

The first grinding chamber 22 is provided with a first grinding ring 24 forming an annular grinding track rigid with the drum inner wall. The profile of the grinding ring 24 can be flat, arched or comprise one or more inclinations. Against the first grinding ring 24 there presses a grinding roller 25 the axis 26 of which, when in the operating position, is essentially parallel to the axis 27 of the drum 11. The grinding roller 25 has a profile conjugate with that of the first grinding ring 24.

The grinding roller 25 is idle and is supported by an external support 28 pivoted at 29 to a base 30 external to the drum 11. An actuator element 31, such as a hydraulic cylinder, is pivoted at its ends to the base 30 and to the external support 28 respectively and is arranged to form a movement and pressure system or lever mechanism. This lever mechanism causes the roller, or rather an outer generating line thereof, to engage against the first grinding ring 24 so as to exert the most appropriate pressure on the material being ground. In addition, by rotating the external support 28 about the pin 29 the grinding roller 25 can be extracted through the drum end opening 21, as shown by dashed lines in FIG. 1.

At that end facing the drum interior, the first chamber 22 is provided with an annular wall 32 projecting radially inwards from the wall of the drum 11. The annular wall 32 defines an element for regulating the quantity of ground material and material still to be ground contained in the first chamber 22 and fed towards the second chamber 23.

The second grinding chamber 23 comprises a second grinding ring 33 against which a second grinding roller 31 is pressed. As in the case of the first chamber, the grinding roller 34 is idle and is supported by an external support 28 pivoted at 29 to a base 30 external to the drum 11. An actuator element 31, such as a hydraulic cylinder, is pivoted at its ends to the base 30 and to the external support 28 respectively and is arranged to cause the roller or an outer generating line thereof to engage against the second grinding ring 33. Again in this case, the actuator element 31 is able to rotate the external support 28 about the pin 29 and to provide the required roller pressure against the grinding track. The grinding roller 25 is extracted by rotating it about the pin 29 through a second drum end opening 35 opposite the first opening 21.

Positionable lifting blades 36 are arranged peripherally on the inner wall of the drum within the second chamber 23, in correspondence with the annular wall 32. The positionable blades 36 are arranged radially with a variable inclination, to lift the material arriving from the first chamber 22. In this manner they facilitate dispersion within the ventilation gas and allow the finest particles to be conveyed by entrainment. The extent of inclination of the blades 36 influences the rate of advancement of the material to be fed to the second grinding ring 33.

The second end opening 35 is defined by a second annular wall 37 which also projects radially towards the interior of the drum to define an element for regulating the quantity of ground material and material still to be ground contained in the second chamber 23. The two annular walls 32 and 37 act as a containment element, their size determining the level of material lying below that grinding roller which precedes them.

At this second drum end opening 35 there is located a second cover element 38, which is fixed to the rotary drum 11. The second cover element 38 is provided with a first duct 39 for discharging the ground material and a second duct 40 for withdrawing the stream of ventilation air or gas mixed with dust.

Figure 3:
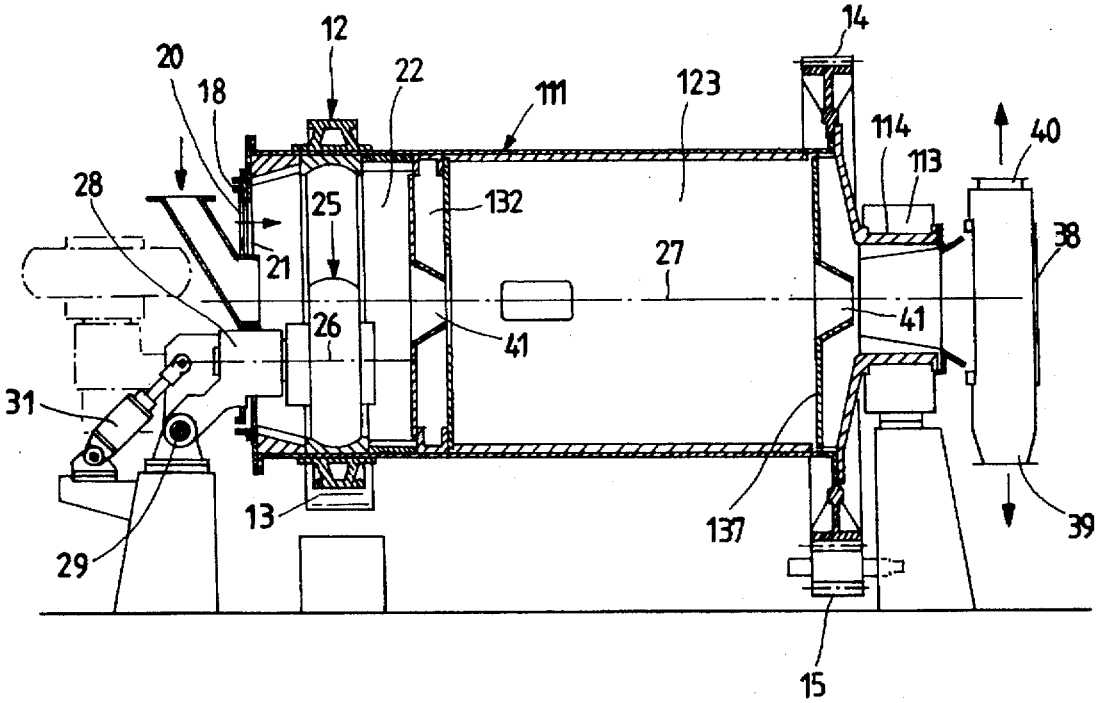
FIG. 3 is a longitudinal section through a further embodiment of the mill according to the invention.

In the second embodiment shown in FIG. 3, the tubular mill comprises within the drum 111 a first grinding chamber 22 similar to the preceding. The first chamber 22 is connected to a second chamber 123 of different type in that it is partly filled with grinding balls, not shown.

Identical elements of the two embodiments are indicated by the same reference numerals, whereas somewhat corresponding elements are indicated by a number preceded by the number "1". The drum 111 is supported at a first end by a pair of rolling-contact rollers 13 and at its other end by a sliding-contact support 113 engaging against a cylindrical extension 114 of the drum.

The first chamber 22 is connected to the second chamber 123 via a slotted baffle 132 provided with a narrow central aperture 41. The opposite end of the second chamber 123 is provided with a similar baffle 137 having a narrow central aperture 41 facing the cylindrical extension 114 of the drum 111. The extension 114 is provided with a second cover element 38, which is fixed to the drum 111. As in the preceding embodiment, the cover element 38 comprises a first duct 39 for discharging the ground material and a second duct 40 for withdrawing the ventilation air or gas stream mixed with ground material dust.

A tubular mill with its structure formed in accordance with the present invention hence provides a first chamber in which rough grinding of the material takes place and a second chamber for finely grinding the previously rough-ground material. With the first embodiment the pressure of the first grinding roller 25 and second grinding roller 34 can be individually adjusted. In addition, the diameter of the fine-grinding second roller 34 can be different, and normally less, than that of the rough-grinding first roller 35. In a further-embodiment, not shown, the second chamber 23 can contain a pair of side-by-side small-diameter grinding rollers instead of one larger-diameter roller 34, so facilitating fine grinding.

The specific grinding energy consumption in a mill according to the invention is substantially reduced. The extent of this reduction is about 50% on traditional tubular ball mills and about 40% on vertical roller mills.

The provision of external supports 28 for the grinding rollers 25 and 34 allows each of them to be easily extracted from the mill, consequently allowing maintenance and replacement of each roller to be done quickly and independently and facilitating cleaning of the drum 11 and 111.

Hence a mill according to the invention enables both rough and fine grinding to be effected in a single machine.

In this respect, with the second described embodiment rough grinding is achieved by compression with low energy consumption, and fine grinding by impact and friction with balls of medium-small diameter under the most suitable conditions for creating material of considerable fineness.

I claim:

1. A tubular mill for grinding natural and synthetic raw materials, comprising:

a rotary cylindrical drum having a horizontal axis and at least two grinding chambers containing grinding elements in which at least one grinding chamber contains grinding elements comprising a roller which when in an operating position has an axis of rotation thereof essentially parallel to the axis of said drum and an independent first external pressure support which supports said roller, said roller being idle and, at least along one of its outer generating lines, engaging an annular grinding track rigid with the inner wall of said drum, wherein said external support comprises an extraction support movable by an actuator element for extraction of said roller, and a feed mouth having said drum provided at one end of said feed mouth for the material to be ground and said drum having a local aperture introducing one of ventilation air and ventilation gas, and a first duct provided at a second end of said drum for discharge of the ground material and a second duct withdrawing said one of said ventilation air and said ventilation gas, and an adjusting mechanism provided between said two grinding chambers, said adjusting mechanism advancing the material which flows inside said drum.

2. A mill as claimed in claim 1, wherein said grinding element of said second chamber comprises a second roller supported by a second support and acting on a second annular grinding track rigid with the inner wall of said drum.

3. A mill as claimed in claim 1, which comprises a base wherein said external support is pivoted to said base and is located externally of said drum, said roller being maintained in an operating position thereof by said actuator element and providing an appropriate roller pressure against the relative track; said roller and external support being rotatable about a pin between said operating position in which said roller is contained within a respective chamber and a position in which said roller is completely extracted.

4. A mill as claimed in claim 1, wherein said actuator element comprises one of a hydraulic and a pneumatic cylinder respectively pivoted at opposite ends thereof to an external fixed point and to said external support.

5. A mill as claimed in claim 1, wherein, downstream of said at least one grinding chamber, said adjusting mechanism is provided wherein said adjusting mechanism comprises an annular wall radially projecting towards an interior portion of said drum.

6. A mill as claimed in claim 5, wherein downstream of said first chamber and of said annular wall a further adjusting mechanism is positioned in a second chamber which comprises a plurality of lifting blades which project radially towards the interior of said drum.

7. A mill as claimed in claim 6, wherein said lifting blades have an adjustable inclination.

8. A mill as claimed in claim 1, wherein the grinding elements located in said second chamber comprise balls.

9. A mill as claimed in claim 8, wherein downstream of said at least two grinding chambers is positioned a further adjusting mechanism which comprises a plurality of baffles having a narrow central aperture.

10. A mill as claimed in claim 8, wherein said drum comprises a rotary drum and a cylindrical extension cooperating with a fixed support, and a rolling ring cooperating with one of rollers and shoes.

11. A mill as claimed in claim 1, wherein said drum is provided externally with two rings each resting on one of a pair of rollers and a pair of shoes.

12. A mill as claimed in claim 1 or 2, wherein said grinding elements of said second chamber comprise a pair of rollers arranged and supported in the same manner as said first roller, each of said pair of rollers acting against annular grinding tracks rigid with the inner wall of said drum.

13. A mill as claimed in claim 1, wherein said feed mouth and local aperture are provided in a first fixed cover element of said drum.

14. A mill as claimed in claim 1, wherein said first duct and second duct are provided in a second fixed cover element of said drum.

15. A tubular mill as claimed in claim 1, wherein said adjusting mechanism comprises a plurality of adjustable baffles mounted on an interior portion of said drum.

* * * * *